US010391773B2

(12) United States Patent
Hirabayashi et al.

(10) Patent No.: US 10,391,773 B2
(45) Date of Patent: Aug. 27, 2019

(54) LIQUID EJECTING APPARATUS

(71) Applicant: SEIKO EPSON CORPORATION, Tokyo (JP)

(72) Inventors: Yuki Hirabayashi, Shiojiri (JP); Kazuhiko Sato, Matsumoto (JP); Masaru Kobashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/447,350

(22) Filed: Mar. 2, 2017

(65) Prior Publication Data

US 2017/0253045 A1 Sep. 7, 2017

(30) Foreign Application Priority Data

Mar. 7, 2016 (JP) ..... 2016-043093

(51) Int. Cl.
*B41J 2/165* (2006.01)

(52) U.S. Cl.
CPC ..... *B41J 2/16541* (2013.01); *B41J 2/16535* (2013.01); *B41J 2/16538* (2013.01); *B41J 2/16544* (2013.01)

(58) Field of Classification Search
CPC ..... B41J 2/16535
See application file for complete search history.

(56) References Cited

U.S. PATENT DOCUMENTS 6,164,754 A * 12/2000 Ide ..... B41J 2/16538 347/20
2002/0122092 A1* 9/2002 Okamura ..... B41J 2/16547 347/33
2008/0007592 A1 1/2008 Watanabe
2014/0292918 A1* 10/2014 Shimizu ..... B41J 2/16535 347/33
2015/0231887 A1 8/2015 Sato

FOREIGN PATENT DOCUMENTS

JP 2006-346890 A 12/2006
JP 2008-012826 A 1/2008
JP 2015-150795 A 8/2015

* cited by examiner

*Primary Examiner* — Kristal Feggins
*Assistant Examiner* — Kendrick X Liu
(74) *Attorney, Agent, or Firm* — Workman Nydegger

(57) ABSTRACT

A liquid ejecting apparatus includes a liquid ejecting head that has a nozzle to eject a liquid and a plurality of surfaces including a nozzle surface in which the nozzle opens, a wiping unit including a first wiping unit for wiping the nozzle surface and a second wiping unit for wiping a surface different from the nozzle surface of the liquid ejecting head, a moving mechanism to relatively move the wiping unit and the liquid ejecting head, and a cleaning member including a cleaning section for cleaning the first wiping unit and the second wiping unit.

16 Claims, 6 Drawing Sheets

LIQUID EJECTING APPARATUS

BACKGROUND

1. Technical Field

The present invention relates to a liquid ejecting apparatus such as a printer.

2. Related Art

An example of a liquid ejecting apparatus is an ink jet printer that includes a nozzle surface wiper that wipes a nozzle surface, which discharges ink, of an ink jet head and a side surface wiper that wipes a side surface that is different from the nozzle surface (for example, see JP-A-2006-346890).

When a wiping operation is performed by using wipers, adherents (waste products) such ink removed from an ink jet head adhere to the wipers. The adherents on the wipers can adhere to the ink jet head again when the next wiping operation is performed.

In order to prevent such readhesion of the adherents to the ink jet head, members different from the wipers may be provided to clean the wipers. However, the cleaning members provided for the individual wipers may complicate the structure of the apparatus.

Such a problem is common not only among printers that eject ink to perform printing, but also among most liquid ejecting apparatuses that have a plurality of wiping sections for wiping a liquid ejecting head.

SUMMARY

An advantage of some aspects of the invention is that there is provided a liquid ejecting apparatus capable of cleaning a plurality of cleaning sections by using a simple structure.

Hereinafter, an apparatus for solving the above-mentioned problem and its operational advantages will be described. A liquid ejecting apparatus that can solve the above-mentioned problem includes a liquid ejecting head that has a nozzle to eject a liquid and a plurality of surfaces including a nozzle surface in which the nozzle opens, a wiping unit including a first wiping unit for wiping the nozzle surface and a second wiping unit for wiping a surface different from the nozzle surface of the liquid ejecting head, a moving mechanism to relatively move the wiping unit and the liquid ejecting head, and a cleaning member including a cleaning section for cleaning the first wiping unit and the second wiping unit.

With this structure, a wiping unit includes a first wiping unit and a second wiping unit that wipe different surfaces of a liquid ejecting head, and a cleaning member cleans the two wiping units. Consequently, when compared to a case where cleaning members are provided in the respective first and second wiping units, the first wiping unit and the second wiping unit can be cleaned by using such a simple structure.

In this liquid ejecting apparatus, the liquid ejecting head may have a side surface that intersects the nozzle surface, the second wiping unit and the first wiping unit may be different units, and the second wiping unit may have a contact surface that comes into contact with the side surface when a wiping operation is performed, and the cleaning section may come into contact with the contact surface in a state the cleaning section is inclined when the cleaning section cleans the second wiping unit.

With this structure, although adherents that have been removed from the side surface by a wiping operation adhere to the contact surface of the second wiping unit, the cleaning section can effectively scrape the adherents that have adhered to the contact surface by coming into contact with the contact surface in a state the cleaning section is inclined during the cleaning operation.

In this liquid ejecting apparatus, the cleaning section may have a cleaning surface that comes into contact with the first wiping unit when the cleaning section cleans the first wiping unit, and an end portion of the cleaning surface comes into contact with the second wiping unit when the cleaning section cleans the second wiping unit.

With this structure, although adherents that have been removed from the liquid ejecting head by a wiping operation adhere to the second wiping unit, the end portion of the cleaning surface of the cleaning member can effectively scrape the adherents that have adhered to the second wiping unit by coming into contact with the second wiping unit during the cleaning operation.

In this liquid ejecting apparatus, on the travel path where the wiping unit and the liquid ejecting head move relatively, at least a portion of the first wiping unit may overlap the second wiping unit, and the cleaning section comes into contact with the second wiping unit and then comes into contact with the first wiping unit.

With this structure, on the travel path where the wiping unit and the liquid ejecting head move relatively, at least a portion of the first wiping unit overlap the second wiping unit. With this arrangement, on the travel path, a cleaning operation of the first wiping unit and the second wiping unit can be performed. Furthermore, if the amount of a liquid adhering to the nozzle surface is larger than an amount of the liquid adhering to another surface and the viscosity of the liquid adhering to the other surface is higher than a viscosity of the liquid adhering to the nozzle surface, the cleaning section first comes into contact with the second wiping unit and then comes into contact with the first wiping unit, and thereby the liquid that has the higher viscosity can be effectively removed by the cleaning section that is clean.

In this liquid ejecting apparatus, the cleaning member may have a container to store adherents removed from the first wiping unit and the second wiping unit. With this structure, adherents that have been removed from the first wiping unit and the second wiping unit are stored in the container in the cleaning member, and thereby the removed adherents can be suppressed from staining the periphery.

The liquid ejecting apparatus may include a removing member to remove the adherents that have been removed from the first wiping unit and the second wiping unit from the cleaning section and move the adherents into the container. With this structure, the removing member can move adherents that have been removed from the first wiping unit and the second wiping unit by the cleaning member into the container.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a liquid ejecting apparatus according to an embodiment will be described with reference to the attached drawings. The liquid ejecting apparatus is, for example, an ink jet printer that performs recording (printing) by ejecting an ink, which is an example liquid, onto a medium such as paper.

Figure 1:
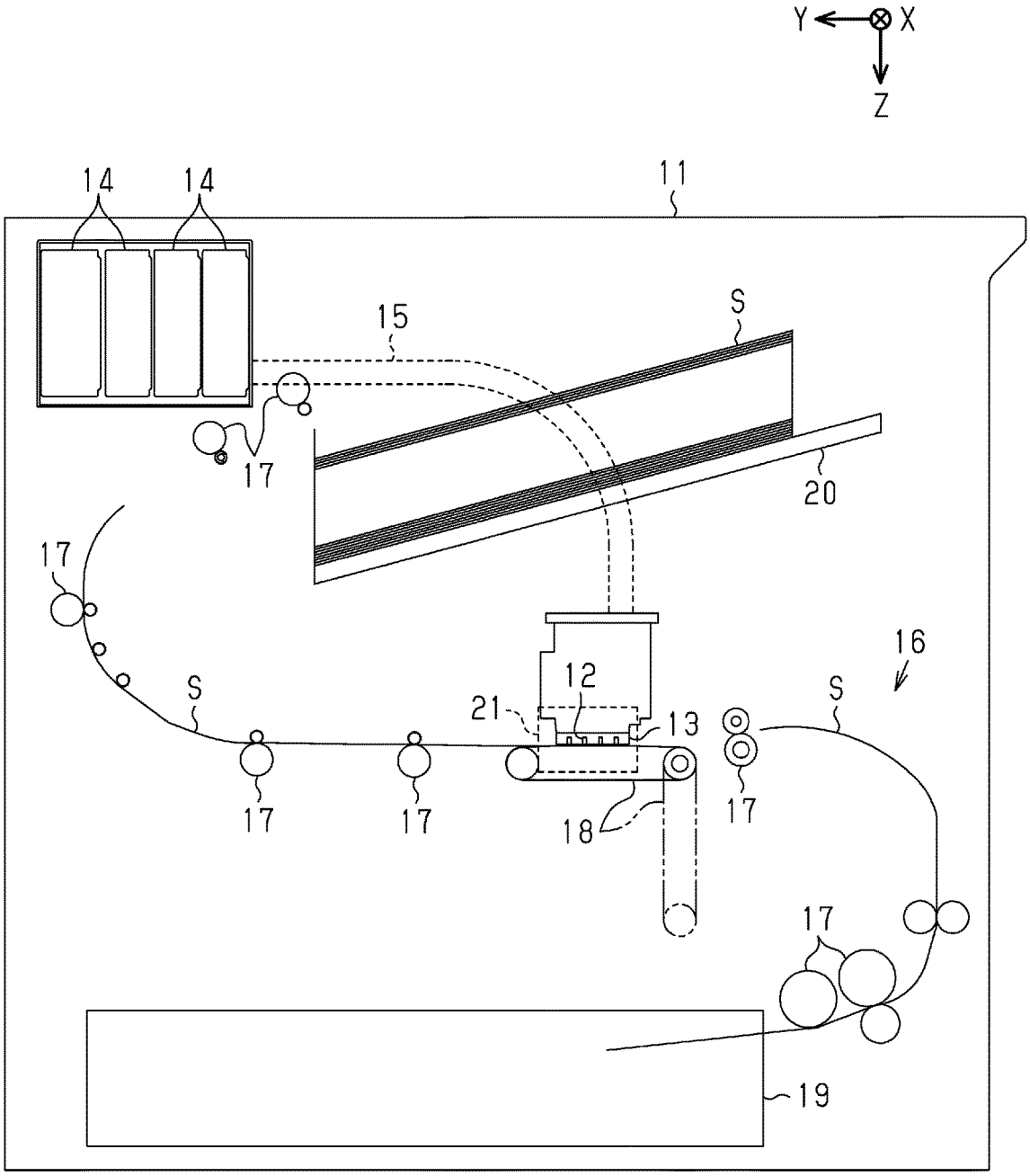
FIG. 1 is a schematic view of a structure of a liquid ejecting apparatus according to an embodiment of the invention.

As illustrated in FIG. 1, a liquid ejecting apparatus 11 according to the embodiment includes a liquid ejecting section 13 that has one or more nozzles 12 to eject liquid in the ejection direction Z, a supply flow path 15 that supplies liquid in a liquid supply source 14 to the liquid ejecting section 13, a transport device 16 that transports a medium S, and a wiping section 21 that performs wiping on the liquid ejecting section 13. A recording position is a position at which the liquid ejecting section 13 ejects liquid. The transport device 16 moves a medium S in the transport direction Y, which intersects (is orthogonal to, in this embodiment) the liquid ejection direction Z, at the recording position.

The liquid supply source 14 may be, for example, a cartridge liquid container that can be attached to the liquid ejecting apparatus 11 to enable liquid supply by detaching, replacing, and attaching a liquid container. Alternatively, the liquid supply source 14 may be a liquid tank that is attached to the liquid ejecting apparatus 11 to enable liquid supply by injecting liquid into the liquid tank.

The liquid ejecting section 13 according to the embodiment is a line head that provides a print region in the transport direction Y and the moving direction X (width direction), which intersects (is orthogonal to, in this embodiment) the ejection direction Z, the print region covering the entire width of a medium S. In this embodiment, the liquid ejection direction Z is the direction of gravity, and alternatively, may be a direction which intersects the direction of gravity.

The transport device 16 includes a plurality of transport rollers 17 that are disposed along a transport path of a medium S, the transport path extending and curving from a storage cassette 19 toward a holding tray 20, and a transport belt 18 that supports the medium S at the recording position. The transport belt 18 moves from a support position indicated by the solid line in FIG. 1 to a retracted position indicated by the chain double-dashed line in FIG. 1 when the wiping section 21 performs wiping of the liquid ejecting section 13.

Figure 2:
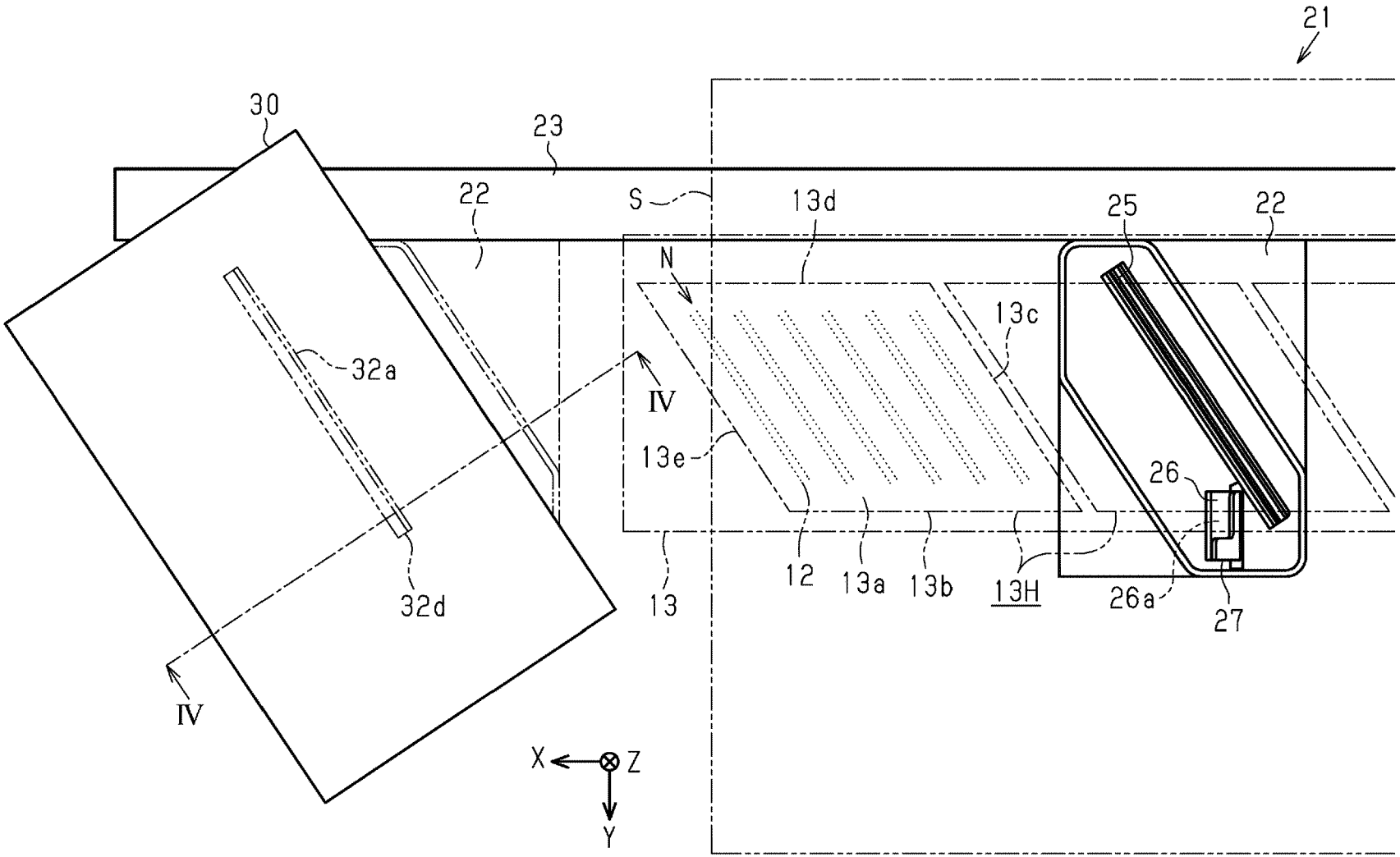
FIG. 2 is a plan view of a liquid ejecting section and a wiping section provided in the liquid ejecting apparatus in FIG. 1.

As illustrated in FIG. 2, the lengthwise direction of the liquid ejecting section 13 according to the embodiment is the width direction (moving direction X) of the medium S, the width direction intersecting the transport direction Y. In the liquid ejecting section 13 according to the embodiment, the nozzles 12 are aligned in a direction obliquely intersecting the transport direction Y and the moving direction X to form a nozzle array N. The liquid ejecting section 13 has a plurality of nozzle arrays N at predetermined intervals in the moving direction X. In this embodiment, a nozzle array direction is a direction in which the nozzle arrays N extend.

The number of the nozzles 12 and the number of the nozzle arrays N that are provided in the liquid ejecting section 13 may be any number. For example, in this embodiment, the liquid ejecting section 13 ejects different liquids (inks of a plurality of colors). The liquid ejecting section 13 has a plurality of (for example, six) liquid ejecting heads 13H for different liquids (inks of different colors) aligned in the moving direction X, the liquid ejecting heads 13H each having the nozzle arrays N.

In the liquid ejecting head 13H, a surface on which the nozzles 12 open is referred to as a nozzle surface 13*a*. The liquid ejecting head 13H has a plurality of (for example, four) side surfaces 13*b*, 13*c*, 13*d*, and 13*e* that intersect the nozzle surface 13*a*. The side surfaces 13*b* and 13*d* extend in the moving direction X and the ejection direction Z, and the side surfaces 13*c* and 13*e* extend in the nozzle array direction and the ejection direction Z.

Next, a structure of the wiping section 21 will be described. The wiping section 21 includes a wiping unit 22 that reciprocates in the moving direction X, a cleaning unit 30 that is disposed near a starting point (near an end point of a reverse travel path) of a forward travel path of the wiping unit 22, and a moving mechanism 23 that moves the wiping unit 22 relative to the liquid ejecting heads 13H and the cleaning unit 30.

The wiping unit 22 includes a first wiping unit 25 that wipes the nozzle surface 13*a* and a second wiping unit 26 that wipes the side surface 13*b*. The first wiping unit 25 may be, for example, an elastically deformable plate-like member in which the lengthwise direction is the nozzle array direction, and it is preferable that the length in the nozzle array direction be longer than a length of the nozzle surface 13*a*.

The second wiping unit 26 wipes the side surface 13*b* that is different from the nozzle surface 13*a* in the liquid ejecting head 13H. The second wiping unit 26 may be, for example, a plate-like member that extends in the transport direction Y, which intersects the side surface 13*b*. The second wiping unit 26 may be formed together with the first wiping unit 25, and it is preferable that the second wiping unit 26 be formed separately from the first wiping unit 25 to increase the degree of freedom of changing the orientations and shapes.

On the travel path where the wiping unit 22 and the liquid ejecting head 13H move relatively, it is preferable that at least a portion of the first wiping unit 25 overlap the second wiping unit 26. In this embodiment, the first wiping unit 25 is positioned such that a portion (a portion on the downstream side in the transport direction Y) of the first wiping unit 25 on one end side in the lengthwise direction overlaps (is aligned with) a portion of the second wiping unit 26 in the moving direction X.

Figure 3:
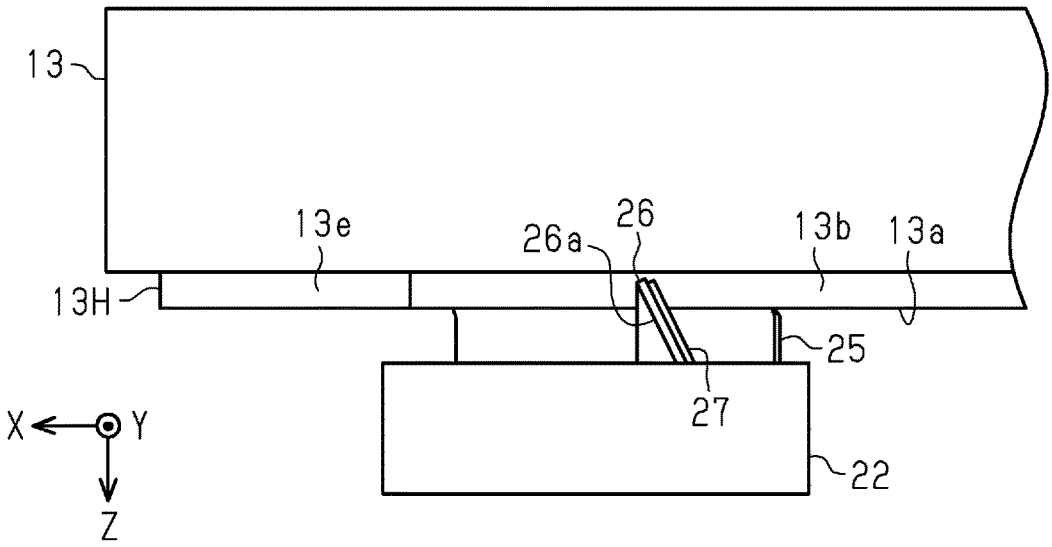
FIG. 3 is a front view of the liquid ejecting section and the wiping section in FIG. 2.

As illustrated in FIG. 3, the first wiping unit 25 is disposed to stand vertically upward orthogonal to the nozzle surface 13*a*. The second wiping unit 26 has a contact surface 26*a* that comes into contact with the side surface 13*b* when wiping is performed. It is preferable that the second wiping unit 26 be disposed such that a tip side of the second wiping unit 26 be inclined toward a forward side in the moving direction X to enable the contact surface 26*a* to obliquely come into contact with the side surface 13*b*.

In such a case, it is preferable that a holding section 27 be provided to hold the second wiping unit 26 to enable a corner portion (end portion on an upstream side in the transport direction Y) on the tip side of the second wiping unit 26 to come into contact with the side surface 13*b*. This arrangement enables the contact surface 26*a* of the plate-like second wiping unit 26 to obliquely come into contact with the side surface 13*b* when the second wiping unit 26 moves in the moving direction X such that the contact surface 26*a* wipes the side surface 13*b* to scrape adherents that have adhered to the side surface 13*b*.

Figure 4:
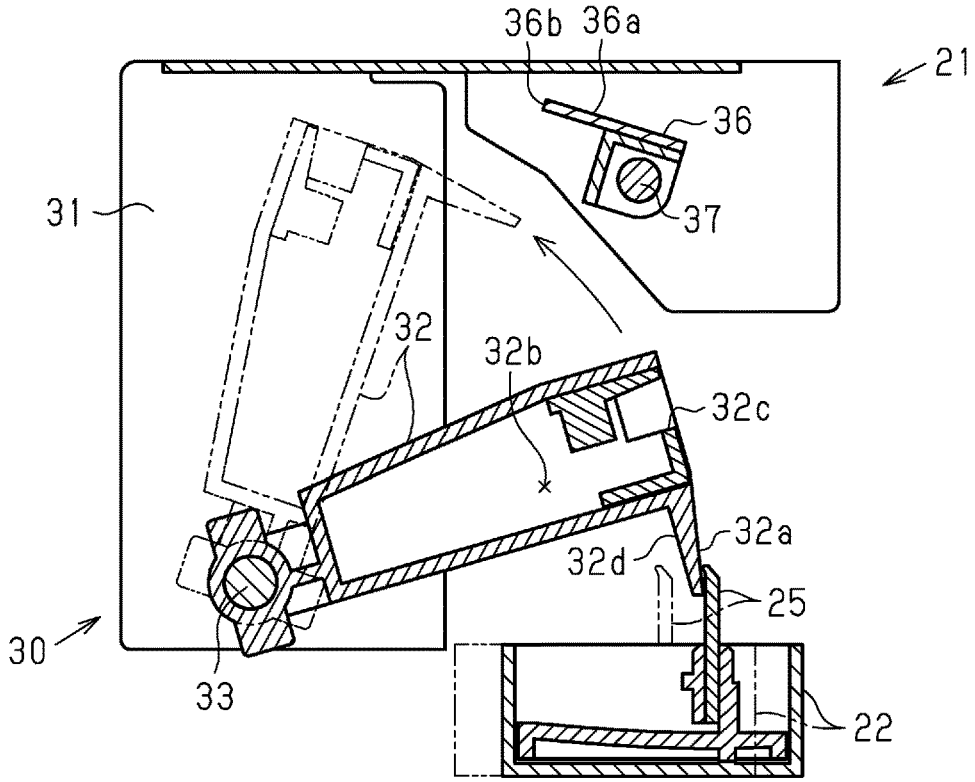
FIG. 4 is a cross-sectional view taken along line IV-IV illustrating the wiping unit that is located at the position indicated by the chain double-dashed lines in FIG. 2.

As illustrated in FIG. 4, the cleaning unit 30 includes a frame section 31, and a cleaning member 32 and a removing member 36 that are rotatably supported by the frame section 31. The cleaning member 32 is, for example, a box-shaped container that has an opening 32*c*. The cleaning member 32 rotates about a rotating shaft 33 that is provided in an end portion on the side opposite to the opening 32*c* within a range (for example, between a first position indicated by the solid lines in FIG. 4 and a second position indicated by the chain double-dashed lines in FIG. 4) the opening 32*c* does not face downward.

A rotating shaft 37 is provided on a base end side of the removing member 36 parallel to the rotating shaft 33 of the cleaning member 32. The removing member 36 has a plate-like section 36*b* on a tip side. The length of the plate-like section 36*b* is substantially equal to the length of the opening 32*c* in the nozzle array direction, and one surface side of the plate-like section 36*b* serves as a removing surface 36*a*. The removing member 36 rotates about the rotating shaft 37 between a retracted position (the position illustrated in FIG. 4) where the removing member 36 does not come into contact with the cleaning member 32 and a contact position (the position illustrated in FIG. 5) where the removing member 36 comes into contact with the cleaning member 32.

The cleaning member 32 has a plate-like cleaning section 32*d* that extends from around the opening 32*c*, and a cleaning surface 32*a* is a surface of the cleaning section 32*d*. The cleaning section 32*d* of the cleaning member 32, specifically, the cleaning surface 32*a* comes into contact with the first wiping unit 25 and the second wiping unit 26 (see FIG. 2) to clean the first wiping unit 25 and the second wiping unit 26. It is preferable that the cleaning surface 32*a* come into contact with the first wiping unit 25 and the second wiping unit 26 at an acute angle such that adherents that have adhered to the first wiping unit 25 and the second wiping unit 26 can be efficiently scraped by the cleaning surface 32*a*.

It is preferable that the cleaning surface 32*a* of the cleaning member 32 be long in the nozzle array direction (see FIG. 2) similarly to the first wiping unit 25 and be longer than the first wiping unit 25 in the nozzle array direction. The cleaning surface 32*a* and the opening 32*c* in the cleaning member 32 are aligned along the rotation path from the first position to the second position.

An inner space of the box-shaped cleaning member 32 serves as a container 32*b* that stores adherents that have been removed from the first wiping unit 25 and the second wiping unit 26. In other words, the cleaning member 32 has the container 32*b* that stores adherents that have been removed from the first wiping unit 25 and the second wiping unit 26.

Next, a wiping operation performed by the wiping section 21 will be described. In the liquid ejecting apparatus 11, when the liquid ejecting section 13 ejects liquid, a fine mist is produced and adheres to the liquid ejecting section 13, and when a medium S is transported, paper powder and dust scatter and adhere to the liquid ejecting section 13. Drying of the liquid (ink) adhered to the liquid ejecting section 13 increases the viscosity of the liquid. Furthermore, when paper powder or dust is mixed with the liquid that has adhered to the liquid ejecting section 13, the viscosity of the liquid increases.

If the liquid is left adhering to the surface 13*a*, droplets ejected from the nozzles 12 come into contact with the adhering liquid and the direction of each of the ejected droplets is changed, which may degrade print quality. Furthermore, the liquid that has adhered to the liquid ejecting section 13 may drip onto a medium S or may come into contact with a curled medium S, which may stain the medium S. To prevent the above-mentioned problems, the liquid ejecting apparatus 11 performs wiping using the wiping section 21 at a predetermined time, for example, after printing has been performed.

The wiping section 21 performs a wiping operation in which the wiping unit 22 wipes the liquid ejecting head 13H of the liquid ejecting section 13 when the wiping unit 22 moves in reverse in the moving direction X. Specifically, the first wiping unit 25 that moves in the moving direction X wipes the nozzle surface 13*a*, and the second wiping unit 26 that moves similarly in the moving direction X wipes the side surface 13*b*.

The nozzle surface 13*a* receives mist that is produced by ejection of liquid, and the amount of the liquid adhering to the nozzle surface 13*a* is larger than the amount of the liquid adhering to the other surfaces (side surfaces 13*b*, 13*c*, 13*d*, and 13*e*). On the other hand, although the amount of the liquid adhering to the side surfaces 13*b*, 13*c*, 13*d*, and 13*e* is smaller than the amount of the liquid adhering to the nozzle surface 13*a*, the viscosity of the liquid increases faster due to drying. In particular, the liquid tends to collect on the side surface 13*b* among the side surfaces 13*b*, 13*c*, 13*d*, and 13*e* as a result of the wiping of the nozzle surface 13*a*, and the viscosity of the liquid on the side surface 13*b* increases faster than that of the other surfaces.

The liquid ejecting section 13, which has a line head, has a plurality of nozzles 12 that are disposed such that a recording region covers the entire medium S, and this structure enables the liquid ejecting section 13 to eject a liquid onto the medium S that is transported in the transport direction Y in a state where the liquid ejecting section 13 is stationary. In this case, when a recording operation is performed, the medium S is moved, and if the medium S is being moved while a liquid ejecting operation is performed, the medium S that has curled (been bent) may come into contact with the liquid ejecting head 13H.

Consequently, if waste products (adherents) such as a liquid have adhered to the side surface 13*b* that is on a downstream side in the transport direction Y or to the nozzle surface 13*a* in the liquid ejecting head 13H, the curled medium S may come into contact with the liquid ejecting head 13H and the medium S may be stained.

In this regard, in the wiping unit 22, the first wiping unit 25 wipes the nozzle surface 13*a*, to which a greater amount of liquid adheres, and furthermore, the second wiping unit 26 wipes the side surface 13*b*. Consequently, even if the medium S comes into contact with the liquid ejecting head 13H, the medium S can be prevented from being stained. Furthermore, the second wiping unit 26 obliquely comes into contact with the side surface 13*b* such that the thickened liquid can be effectively scraped.

Next, operational advantages of the liquid ejecting apparatus 11 having the above-described structure will be described with a focus on a cleaning operation to the wiping unit 22 by the cleaning member 32. When the wiping unit 22 approaches the end point of the travel path when moving in reverse, the cleaning surface 32*a* of the cleaning member 32 that is at a first position comes into contact with the contact surface 26*a* of the second wiping unit 26, and the cleaning surface 32*a* cleans the contact surface 26*a* that has scraped adherents such as a liquid from the side surface 13*b*.

During this operation, as illustrated in FIG. 2, the cleaning surface 32*a* of the cleaning member 32 is inclined against the contact surface 26*a* of the second wiping unit 26 in plan view illustrating the wiping section 21 in the ejection direction Z. In plan view, the second wiping unit 26 is located such that the second wiping unit 26 overlaps in the moving direction X with an end portion of the cleaning surface 32*a* in the lengthwise direction. With this structure, when the cleaning member 32 performs a cleaning operation on the second wiping unit 26, the end portion of the cleaning surface 32*a* (cleaning section 32*d*) comes into contact with the contact surface 26*a* in the inclined state to scrape adherents such as a thickened liquid adhering to the contact surface 26*a*.

After the cleaning surface 32*a* of the cleaning section 32*d* has come into contact with the second wiping unit 26, if the wiping unit 22 is further moved in the moving direction X, the cleaning member 32 comes into contact with the first wiping unit 25. After the cleaning section 32*d* (cleaning surface 32*a*) has come into contact with the first wiping unit 25 as illustrated in FIG. 4 by the solid lines, if the wiping unit 22 is further moved in reverse to the end point along the reverse travel path as illustrated in FIG. 4 by the chain double-dashed lines, the liquid or the like that has adhered to the first wiping unit 25 is scraped by the cleaning surface 32*a*, and thereby the first wiping unit 25 is cleaned. As described above, the cleaning member 32 sequentially performs the cleaning operation of the second wiping unit 26 and the cleaning operation of the first wiping unit 25 with the movement of the wiping unit 22, and thereby the time required for the cleaning can be reduced.

The cleaning member 32 that has cleaned the first wiping unit 25 rotates in the direction indicated by the arrow in FIG. 4 from the first position indicated by the solid lines in FIG. 4 to the second position indicated by the chain double-dashed lines in FIG. 4. During this movement, the removing member 36 is in a retracted position illustrated in FIG. 4 to avoid coming into contact with the rotating cleaning member 32. The removing member 36 may rotate from the contact position to the retracted position in response to the rotation of the cleaning member 32.

Figure 5:
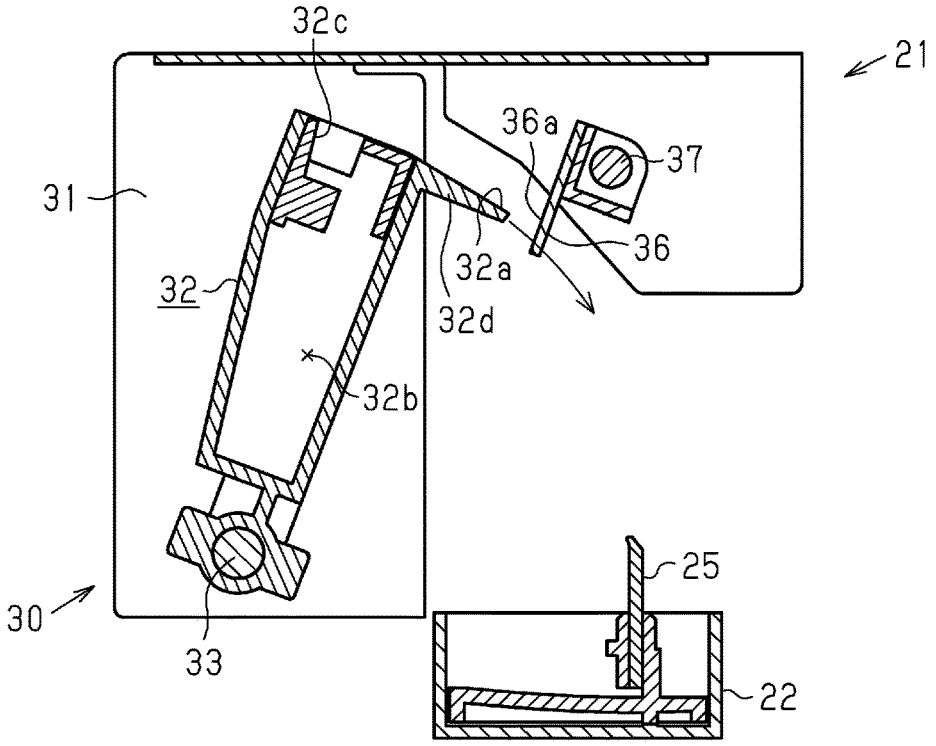
FIG. 5 is a cross-sectional view of a cleaning member and a removing member that are rotated from the positions in FIG. 4.

When the rotating cleaning member 32 reaches the second position, as illustrated in FIG. 5, the removing member 36 rotates from the retracted position illustrated in FIG. 4 to the contact position illustrated in FIG. 5. In this position, the removing surface 36*a* of the removing member 36 faces the cleaning member 32 that is at the second position.

Then, the cleaning member 32 rotates from the second position in the direction indicated by the arrow in FIG. 5, and the cleaning surface 32*a* comes into contact with the removing surface 36*a* of the removing member 36. As a result of the contact, the adherents such as the liquid that has been scraped by the cleaning member 32 from the first wiping unit 25 and the second wiping unit 26 are removed from the cleaning surface 32*a* by the removing member 36.

Figure 6:
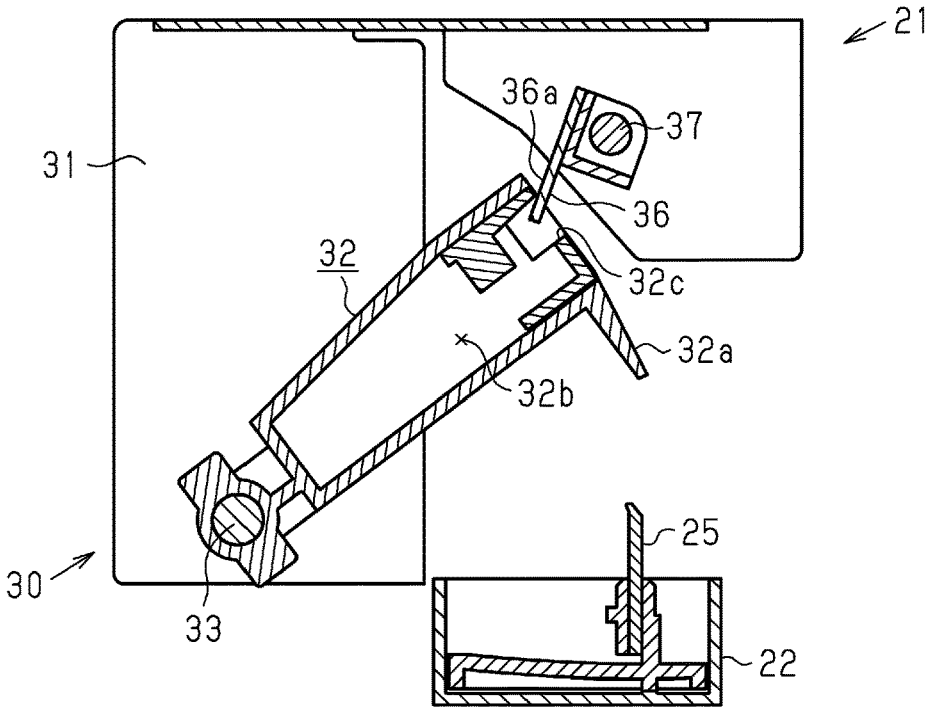
FIG. 6 is a cross-sectional view of the removing member in FIG. 5 that moves adherents into a container.

Then, as illustrated in FIG. 6, if the cleaning member 32 further rotates toward the first position, the adherents that have been removed from the cleaning surface 32*a* by the removing member 36 are moved toward the opening 32*c*, and the adherents are put into the container 32*b*. In other words, the removing surface 36*a* of the removing member 36 removes the adherents, which have been removed from the first wiping unit 25 and the second wiping unit 26 by the cleaning section 32*d*, from the cleaning section 32*d* and moves the adherents into the container 32*b*.

By this operation, the cleaning operation of the first wiping unit 25 and the second wiping unit 26 by the cleaning member 32 is completed, and the cleaning member 32 that stores the adherents in the container 32*b* returns to the first position. As described above, the adherents are stored in the container 32*b* and thereby the cleaning operation is completed. By this operation, when the cleaning member 32 performs a cleaning operation of the first wiping unit 25 and the second wiping unit 26 next, the first wiping unit 25 and the second wiping unit 26 can be prevented from being stained by adherents, and further, readhesion of the adherents to the liquid ejecting head 13H by the stained first wiping unit 25 and second wiping unit 26 can be prevented.

It should be noted that the wiping unit 22 according to the embodiment moves to a position shifted in the ejection direction Z or in the transport direction Y to avoid coming into contact with the liquid ejecting section 13 in the forward movement. The wiping unit 22 performs a wiping operation when the wiping unit 22 moves in the moving direction X in the reverse movement. According to the embodiment, the wiping unit 22 moves to a shifted position in the forward movement to avoid unnecessary contact with the liquid ejecting section 13. Alternatively, the liquid ejecting section 13 may move in the ejection direction Z or in the transport direction Y to avoid unnecessary contact with the wiping unit 22 that is in the forward movement.

According to the above-described embodiment, the following advantages can be achieved.

(1) The wiping unit 22 includes the first wiping unit 25 and the second wiping unit 26 that wipe different surfaces of the liquid ejecting head 13H, and the cleaning member 32 cleans the two wiping units 25 and 26.

Consequently, when compared to a case where cleaning members are provided in the respective first wiping unit 25 and second wiping unit 26, the first wiping unit 25 and the second wiping unit 26 can be cleaned by using such a simple structure.

(2) To the contact surface 26*a* of the second wiping unit 26, adherents (waste products) such as a liquid removed from the side surface 13*b* through a wiping operation adhere. The cleaning section 32*d* can effectively scrape the adherents that have adhered to the contact surface 26*a* by coming into contact with the contact surface 26*a* in a state the cleaning section 32*d* is inclined during the cleaning operation.

(3) To the second wiping unit 26, adherents (waste products) removed from the liquid ejecting head 13H through a wiping operation adhere. The end portion of the cleaning surface 32*a* of the cleaning member 32 can effectively scrape the adherents that have adhered to the second wiping unit 26 by coming into contact with the second wiping unit 26 during the cleaning operation.

(4) On the travel path where the wiping unit 22 and the liquid ejecting head 13H move relatively, at least a portion of the first wiping unit 25 overlaps the second wiping unit 26. With this arrangement, on the travel path, a cleaning operation of the first wiping unit 25 and the second wiping unit 26 can be performed. Furthermore, if the amount of a liquid adhering to the nozzle surface 13*a* is larger than an amount of the liquid adhering to another surface (side surface 13*b*) and the viscosity of the liquid adhering to the side surface 13*b* is higher than a viscosity of the liquid adhering to the nozzle surface 13*a*, the cleaning section 32*d* first comes into contact with the second wiping unit 26 and then comes into contact with the first wiping unit 25, and thereby the liquid that has the higher viscosity can be effectively removed by the cleaning section 32*d* that is clean.

(5) Adherents removed from the first wiping unit 25 and the second wiping unit 26 are stored in the container 32*b* in the cleaning member 32, and thereby the removed adherents can be suppressed from staining the periphery.

(6) The removing member 36 can move adherents that have been removed from the first wiping unit 25 and the second wiping unit 26 by the cleaning section 32*d* into the container 32*b*. It should be noted that the above-described embodiment can be modified as modifications described below. The above-described embodiment and the following modifications may be combined in any combination.

Figure 7:
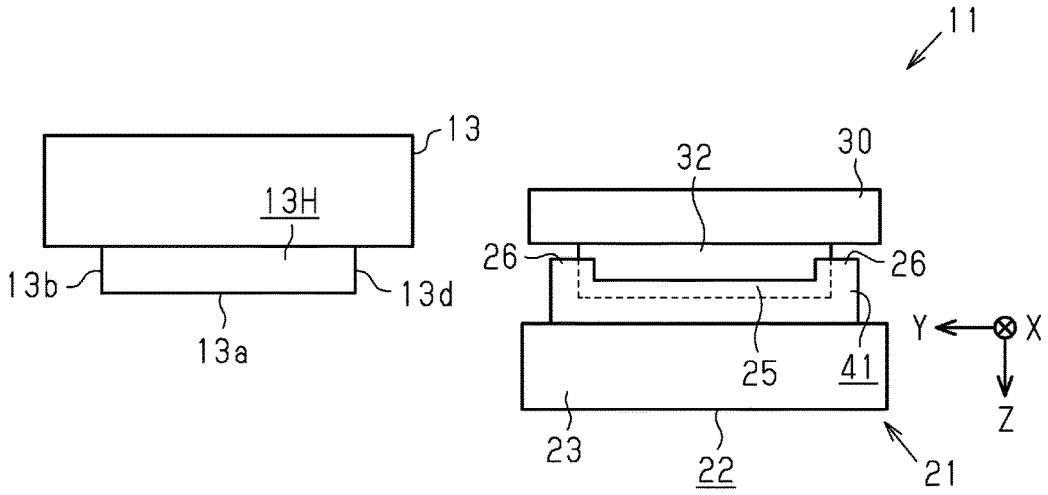
FIG. 7 is a front view of a liquid ejecting apparatus according to a first modification.

As in a first modification illustrated in FIG. 7, the wiping unit 22 may include a wiping member 41 in which the first wiping unit 25 and the second wiping unit 26 are integrated. The wiping member 41 according to the first modification includes the first wiping unit 25 and the second wiping unit 26 that have different heights, and the first wiping unit 25 comes into contact with the nozzle surface 13*a* and the second wiping unit 26 comes into contact with the side surfaces 13*b* and 13*d*. In the first modification, the liquid ejecting section 13 moves between the recording position (the position illustrated in FIG. 7) where liquid ejection is performed and the position where wiping is performed.

As in the first modification illustrated in FIG. 7, the wiping member 41 includes a pair of second wiping units 26 that comes into contact with the side surfaces 13*b* and 13*d* to wipe the side surfaces 13*b* and 13*d* in a single wiping operation.

In the first modification illustrated in FIG. 7, the moving mechanism 23 may move the wiping member 41 upward and downward such that the wiping member 41 is moved between a position where a wiping operation is performed only by the second wiping unit 26 and a position where a wiping operation is performed by the first wiping unit 25 and the second wiping unit 26. With this structure, a wiping operation can be selectively performed between a wiping operation for wiping only the side surfaces 13*b* and 13*d* and a wiping operation for wiping both the nozzle surface 13*a* and the side surfaces 13*b* and 13*d*. Consequently, the side surfaces 13*b* and 13*d* can be repeatedly wiped to sufficiently remove a thickened liquid, or the wiping of the nozzle surface 13*a* can be avoided to prevent further damage to the nozzle surface 13*a* caused by wiping. Instead of moving the wiping member 41 upward and downward by the moving mechanism 23, the liquid ejecting section 13 may move upward and downward to selectively perform a wiping operation between a wiping operation for wiping only the side surfaces 13*b* and 13*d* and a wiping operation for wiping both the nozzle surface 13*a* and the side surfaces 13*b* and 13*d*.

Furthermore, when the cleaning member 32 performs a cleaning operation, the wiping member 41 may be moved upward and downward such that the cleaning member 32 can selectively perform a cleaning operation between a cleaning operation for cleaning only the second wiping unit 26 and a cleaning operation for cleaning both the first wiping unit 25 and the second wiping unit 26. Consequently, the first wiping unit 25 can be prevented from becoming deteriorated due to repetitive cleaning of the first wiping unit 25. Instead of moving the wiping member 41 upward and downward by the moving mechanism 23, the cleaning unit 30 may move the cleaning member 32 upward and downward to selectively perform a cleaning operation between a cleaning operation for cleaning only the second wiping unit 26 and a cleaning operation for cleaning both the first wiping unit 25 and the second wiping unit 26.

Figure 8:
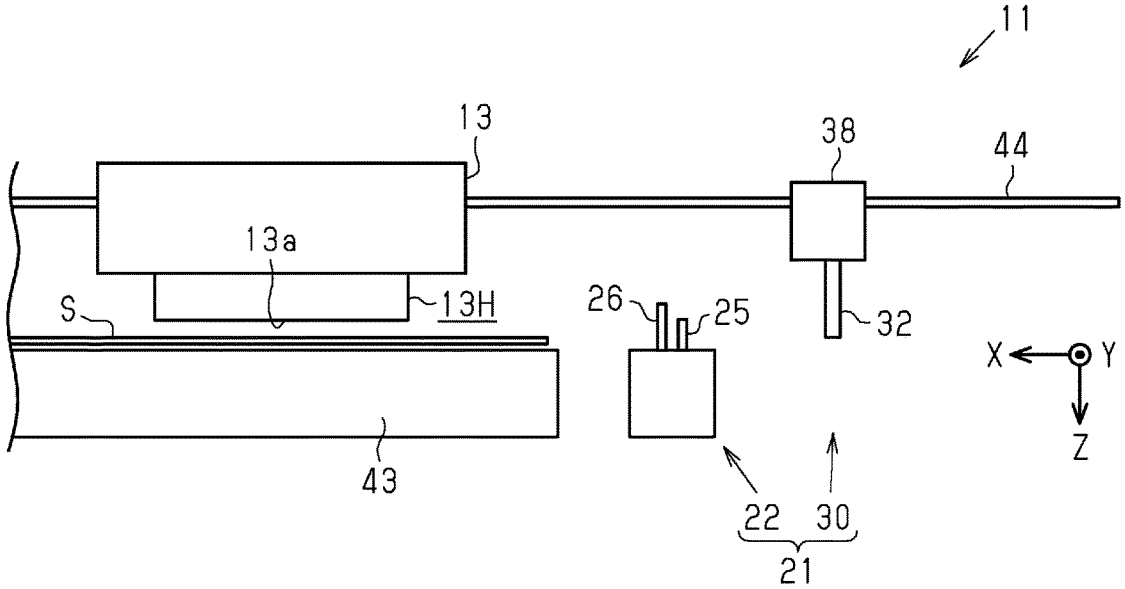
FIG. 8 is a front view of a liquid ejecting apparatus according to a second modification.

As in a second modification illustrated in FIG. 8, the liquid ejecting section 13 may eject a liquid to perform recording while reciprocating along a guide shaft 44 that extends in the moving direction X, which intersects the direction Y in which a medium S is transported. In such a case, the wiping section 21 may be disposed at a position aligned with a supporting base 43 that supports a medium S in the moving direction X, and a wiping operation may be performed by moving the liquid ejecting section 13 in the moving direction X with respect to the fixed wiping unit 22.

As in the second modification illustrated in FIG. 8, in the case where the wiping unit 22 does not move in the wiping direction (moving direction X), the cleaning member 32 may be moved in the moving direction X to clean the first wiping unit 25 and the second wiping unit 26. In such a case, a moving member 38 that holds the cleaning member 32 and moves along the guide shaft 44 may be provided.

Figure 9:
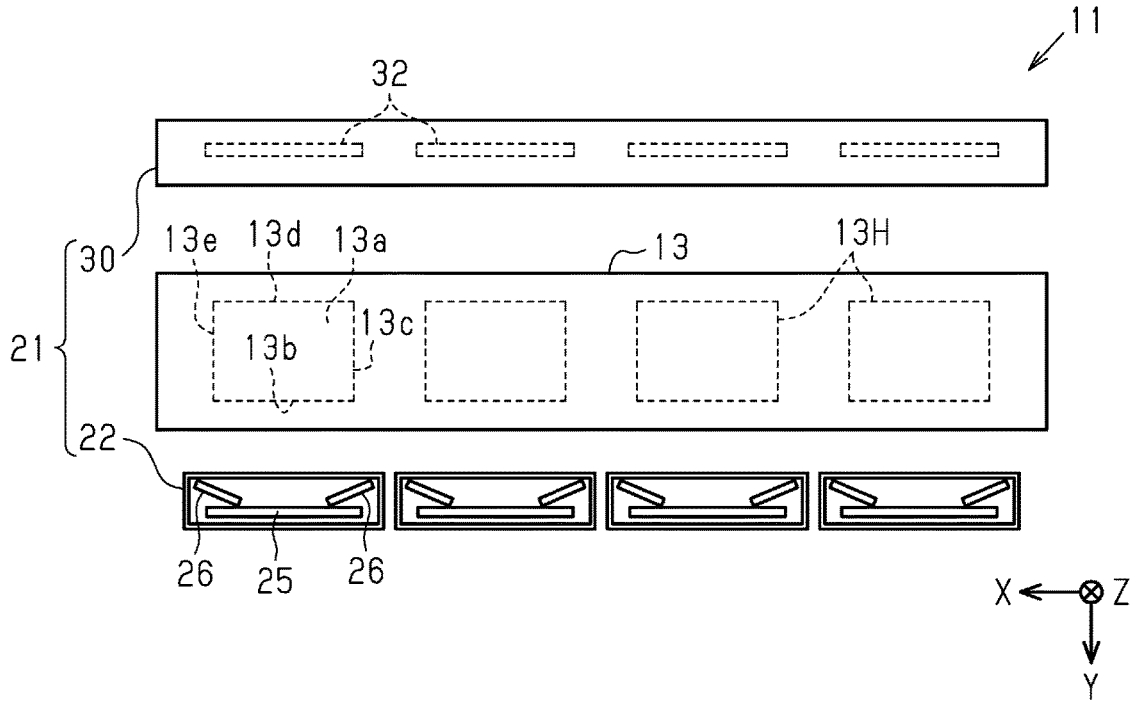
FIG. 9 is a plan view of a liquid ejecting apparatus according to a third modification.
Figure 10:
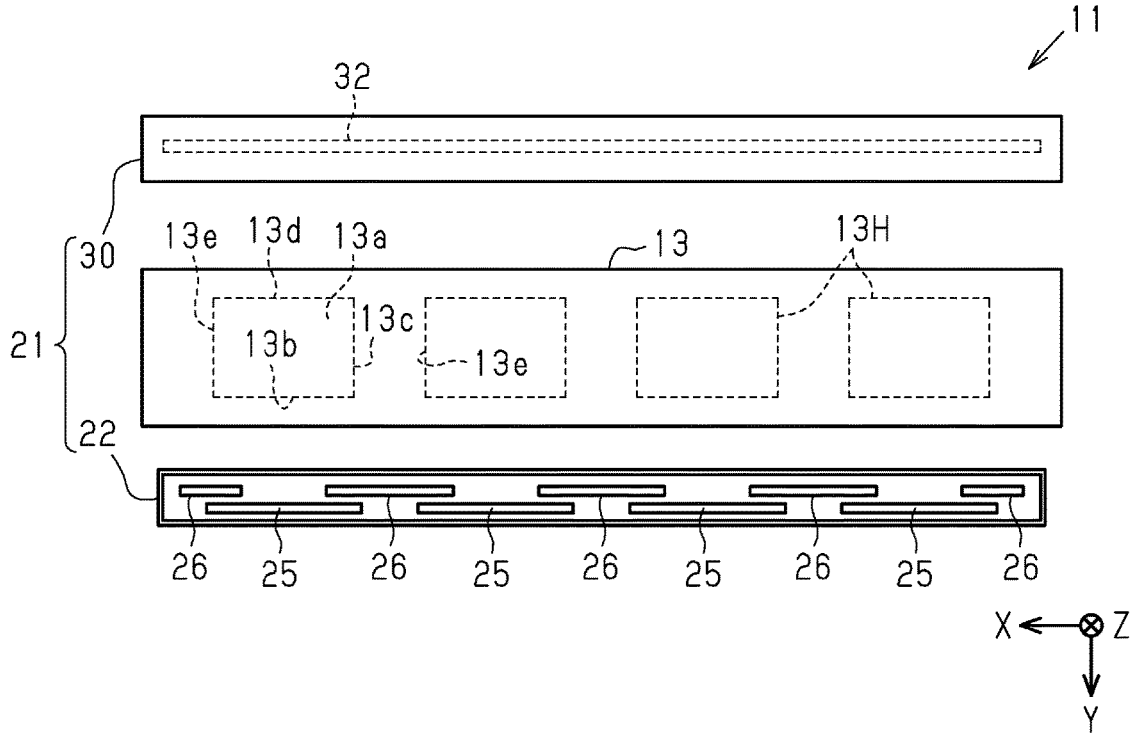
FIG. 10 is a plan view of a liquid ejecting apparatus according to a fourth modification.

As in a third modification illustrated in FIG. 9 and a fourth modification illustrated in FIG. 10, the wiping unit 22 may reciprocate in the transport direction Y to perform a wiping operation. In such a case, as in the third modification illustrated in FIG. 9, the wiping unit 22 that includes the first wiping unit 25 and the second wiping unit 26 may be provided in each liquid ejecting head 13H, or as in the fourth modification illustrated in FIG. 10, the wiping unit 22 that performs a wiping operation of a plurality of liquid ejecting heads 13H with a single operation may be provided. As in the third modification illustrated in FIG. 9, the cleaning unit 30 may include a plurality of cleaning members 32 that correspond to a plurality of wiping units 22 respectively. Alternatively, as in the fourth modification illustrated in FIG. 10, the cleaning unit 30 may include the cleaning member 32 that can clean a plurality of first wiping units 25 and a plurality of second wiping units 26.

As in the third modification in FIG. 9 and in the fourth modification in FIG. 10, the wiping unit 22 may include a pair of second wiping units 26 that wipe a pair of side surfaces 13*c* and 13*e*, which are parallel to each other. In such a case, as in the third modification illustrated in FIG. 9, a pair of second wiping units 26 may be provided for each liquid ejecting head 13H. Alternatively, as in the fourth modification illustrated in FIG. 10, the second wiping units 26 each wipe the side surfaces 13*c* and 13*e*, which are opposite to each other, of adjacent liquid ejecting heads 13H may be provided.

As in the fourth modification illustrated in FIG. 10, the second wiping units 26 may not be inclined with respect to the side surfaces 13*c* and 13*e* of the liquid ejecting heads 13H and the cleaning member 32.

The cleaning unit 30 may omit the removing member 36. In such a case, the cleaning member 32 may be formed of a material that can absorb liquid, and the cleaning member 32 may absorb and store a liquid that has adhered to the first wiping unit 25 and the second wiping unit 26.

The cleaning member 32 may omit the container 32*b*, and the removing member 36 may move adherents that have been removed from the cleaning surface 32*a* to a place distant from the cleaning member 32.

The wiping unit 22 may perform a wiping operation in a forward movement, or may perform a wiping operation in both forward and reverse movements.

The second wiping unit 26 may wipe, in addition to the side surfaces 13*b*, 13*c*, 13*d*, and 13*e*, which intersect the nozzle surface 13*a*, of the liquid ejecting head 13H, another surface of the liquid ejecting head 13H that is distant from the nozzle surface 13*a*.

Surfaces to be wiped by the first wiping unit 25 and the second wiping unit 26 are not limited to flat surfaces, for example, surfaces that have projections, steps, or grooves may be wiped.

The nozzles 12 on the liquid ejecting head 13H may be provided not in the form of the nozzle array N but in a random arrangement such that a recording range covers the entire medium S. Alternatively, the nozzles 12 may be provided as a long nozzle array N such that a recording range covers the entire medium S.

A liquid that is ejected by the liquid ejecting section 13 is not limited to an ink, and alternatively, the liquid may be, for example, a fluid that contains particles of a functional material dispersed or mixed in a liquid. For example, a liquid material containing a dispersed or dissolved material such as an electrode material or a color material (pixel material) used for manufacturing liquid crystal displays, electroluminescence (EL) displays, or field emission displays may be ejected for recording.

The medium is not limited to paper, and alternatively, for example, plastic films, thin plate materials, and cloths used in printing apparatuses may be used.

The entire disclosure of Japanese Patent Application No. 2016-043093, filed Mar. 7, 2016 is expressly incorporated by reference herein.

What is claimed is:

1. A liquid ejecting apparatus comprising:

a liquid ejecting head that has a nozzle configured to eject a liquid in a liquid ejecting direction and a plurality of surfaces including a nozzle surface in which the nozzle opens and a side surface that intersects the nozzle surface;

a wiping unit including a first wiping unit for wiping the nozzle surface in a wiping direction that the nozzle surface and the side surface extend and a second wiping unit for wiping the side surface in the wiping direction, the second wiping unit having a contact surface with a first portion and a second portion, the first portion being closer to the side surface than the second portion;

a moving mechanism configured to relatively move the wiping unit and the liquid ejecting head; and a cleaning member including a cleaning section for cleaning the first wiping unit and the second wiping unit, wherein the cleaning section includes a cleaning surface that comes into contact with the contact surface when the cleaning section cleans the second wiping unit, and wherein the cleaning surface is inclined to the contact surface as viewed from the liquid ejecting direction, the cleaning surface being configured to contact the first portion following the cleaning surface contacting the second portion.

2. The liquid ejecting apparatus according to claim 1, wherein the first wiping unit includes another contact surface that comes into contact with the nozzle surface when the wiping operation is performed, wherein the cleaning surface comes into contact with the another contact surface when the cleaning section cleans the first wiping unit, and wherein a longitudinal direction of the cleaning surface is a longitudinal direction of the another contact surface.

3. The liquid ejecting apparatus according to claim 2, wherein, on the travel path where the wiping unit and the liquid ejecting head move relatively, at least a portion of the first wiping unit overlaps the second wiping unit, and the cleaning section comes into contact with the second wiping unit and then comes into contact with the first wiping unit.

4. The liquid ejecting apparatus according to claim 1, wherein the cleaning section has the cleaning surface that comes into contact with the first wiping unit when the cleaning section cleans the first wiping unit, and an end portion of the cleaning surface comes into contact with the second wiping unit when the cleaning section cleans the second wiping unit.

5. The liquid ejecting apparatus according to claim 4, wherein, on the travel path where the wiping unit and the liquid ejecting head move relatively, at least a portion of the first wiping unit overlaps the second wiping unit, and the cleaning section comes into contact with the second wiping unit and then comes into contact with the first wiping unit.

6. The liquid ejecting apparatus according to claim 4, wherein the cleaning member has a container configured to store adherents removed from the first wiping unit and the second wiping unit.

7. The liquid ejecting apparatus according to claim 6, further comprising:

a removing member configured to remove the adherents removed from the first wiping unit and the second wiping unit from the cleaning section and move the adherents into the container.

8. The liquid ejecting apparatus according to claim 1, wherein an end portion of the cleaning surface in a longitudinal direction of the cleaning surface comes into contact with the second wiping unit when the cleaning section cleans the second wiping unit.

9. The liquid ejecting apparatus according to claim 8, wherein, on a travel path where the wiping unit and the liquid ejecting head move relatively, at least a portion of the first wiping unit overlaps the second wiping unit, and the cleaning section comes into contact with the second wiping unit and then comes into contact with the first wiping unit.

10. The liquid ejecting apparatus according to claim 1, wherein, on the travel path where the wiping unit and the liquid ejecting head move relatively, at least a portion of the first wiping unit overlaps the second wiping unit, and the cleaning section comes into contact with the second wiping unit and then comes into contact with the first wiping unit.

11. The liquid ejecting apparatus according to claim 10, wherein the cleaning member has a container configured to store adherents removed from the first wiping unit and the second wiping unit.

12. The liquid ejecting apparatus according to claim 11, further comprising:

a removing member configured to remove the adherents removed from the first wiping unit and the second wiping unit from the cleaning section and move the adherents into the container.

13. The liquid ejecting apparatus according to claim 1, further comprising:

a removing member configured to scrape the cleaning surface and to remove adherents removed from the first wiping unit and the second wiping unit from the cleaning section.

14. The liquid ejecting apparatus according to claim 13, wherein the cleaning member includes a container configured to store the adherents removed from the cleaning section by the removing member, and wherein the removing member is configured to move the adherents into the container.

15. The liquid ejecting apparatus according to claim 14, wherein the removing member and the container are configured separately, and wherein the cleaning section and the container are integrated.

16. The liquid ejecting apparatus according to claim 1, wherein a tip side of the contact surface on a side close to the nozzle surface is inclined toward a forward side in the wiping direction such that the second wiping unit obliquely contacts the side surface.

* * * * *